US012624620B1

(12) United States Patent
Allahar

(10) Patent No.: US 12,624,620 B1
(45) Date of Patent: May 12, 2026

(54) HYDRAULIC FRACTURING SYSTEM AND METHOD USING A DOWNHOLE PULSING TOOL

(71) Applicant: Ian Allahar, Katy, TX (US)

(72) Inventor: Ian Allahar, Katy, TX (US)

(73) Assignee: Ian A. Allahr, Katy, TX (US)

( * ) Notice: Subject to any disclaimer, the term of this patent is extended or adjusted under 35 U.S.C. 154(b) by 0 days.

(21) Appl. No.: 19/063,272

(22) Filed: Feb. 25, 2025

(51) Int. Cl.
*E21B 43/26* (2006.01)
*E21B 23/01* (2006.01)
*E21B 47/06* (2012.01)

(52) U.S. Cl.
CPC ..... *E21B 43/26* (2013.01); *E21B 23/01* (2013.01); *E21B 47/06* (2013.01)

(58) Field of Classification Search
CPC ..... E21B 43/26; E21B 23/01; E21B 47/06
See application file for complete search history.

(56) References Cited

U.S. PATENT DOCUMENTS

2006/0070740 A1* 4/2006 Surjaatmadja ..... E21B 43/114 166/308.1

FOREIGN PATENT DOCUMENTS

CN 116335615 A * 6/2023 ..... E21B 43/26

* cited by examiner

*Primary Examiner* — Dany E Akakpo

(57) ABSTRACT

A downhole hydraulic fracturing system and method utilizing downhole pressure pulsing to enhance fracture propagation, proppant transport, and reservoir permeability. The system employs a hybrid fracturing approach that integrates conventional hydraulic fracturing with downhole pulse hydraulic fracturing. This hybrid technique reduces surface energy demands, enhances fracture initiation, increases fracture density, and improves proppant distribution, thereby maximizing reservoir permeability and overall production efficiency. The system is configured to include: a mechanism that enables real-time, surface-controlled adjustment of pulse intensity; a downhole system capable of generating self-sustained pulsing independent of tubular movement, a downhole sensor system configured to detect, record, and analyze downhole fluid pressure and other critical parameters and additional embodiments that enhance energy transfer efficiency, increase fracture complexity, and optimize proppant transport.

6 Claims, 5 Drawing Sheets

HYDRAULIC FRACTURING SYSTEM AND METHOD USING A DOWNHOLE PULSING TOOL

CROSS REFERENCE TO RELATED APPLICATIONS

This application is a continuation-in-part of, and claims benefit of, U.S. application Ser. No. 12/084,954, filed on Sep. 8, 2023, and assigned to the assignee of the present application. The entirety of U.S. application Ser. No. 12/084,954 is hereby incorporated by reference.

BACKGROUND

Field of the Invention

Embodiments disclosed herein relate generally to apparatus and methods for creating and stimulating fractures within a subsurface formation using wellbore-deployed tools capable of generating pulse-based hydraulic fracturing.

More specifically, the present disclosure pertains to a downhole reservoir stimulation tool operatively coupled to an injector tool, enabling a hybrid fracturing approach that integrates conventional hydraulic fracturing with downhole pulse hydraulic fracturing.

This hybrid technique reduces surface energy demands, enhances fracture initiation, increases fracture density, and improves proppant distribution, thereby maximizing reservoir permeability and overall production efficiency.

Unlike the system disclosed in U.S. application Ser. No. 12/084,954, this present disclosure includes: a mechanism that enables real-time, surface-controlled adjustment of pulse intensity; a downhole system capable of generating self-sustained pulsing independent of tubular movement, a downhole sensor system configured to detect, record, and analyze downhole fluid pressure and other critical parameters and additional embodiments that enhance energy transfer efficiency, increase fracture complexity, and optimize proppant transport.

The present disclosure and the hybrid technique introduced can be applied to all areas where hydraulic fracturing is performed; such as, but not limited to, hydraulic fracturing of new wells, hydraulic fracturing of mature wells, hydraulic fracturing of geothermal well, hydraulic fracturing in carbon capture and storage operations, hydraulic fracturing in critical elements mining operations.

Background Art

Hydraulic fracturing, commonly referred to as "fracking," has been widely utilized for decades to enhance hydrocarbon production from both conventional and unconventional reservoirs, as well as geothermal formations. The technique involves the high-pressure injection of fracturing fluid-typically composed of water, proppant, and chemical additives-into a wellbore to create fractures in the rock, thereby increasing formation permeability and improving fluid flow.

Since its early development, hydraulic fracturing has evolved significantly. Traditional hydraulic fracturing methods primarily rely on a constant-flow, sustained-pressure injection approach, where fracturing fluid is continuously pumped at high pressure to propagate fractures. Advances in horizontal drilling and multi-stage fracturing have enabled access to low-permeability formations, such as shale, unlocking vast hydrocarbon reserves. However, research indicates that constant-flow hydraulic fracturing exhibits several fundamental inefficiencies compared to variable or pulse-based fracturing techniques.

Despite its success in stimulating reservoirs, conventional hydraulic fracturing presents significant efficiency and operational limitations: Key challenges associated with conventional hydraulic fracturing include:

Limited Energy Efficiency—Pressure transmission from the surface to the formation is inefficient due to frictional losses within the wellbore, reducing the overall energy available for fracture propagation.

Restricted Fracture Complexity—Continuous high-pressure injection tends to produce predominantly planar fractures, limiting the development of secondary and tertiary fracture networks necessary for increased permeability.

Inconsistent Proppant Transport—Proppant distribution within fractures is often uneven, as settling effects reduce fracture conductivity and long-term reservoir performance.

High Environmental Impact—Conventional hydraulic fracturing operations require large volumes of water and chemical additives, produce toxic flowback fluids, and generate high $CO_2$ emissions from diesel-powered pumping systems.

Recent studies and field trials have demonstrated that variable-pressure pulse hydraulic fracturing—where fluid injection pressure is cyclically modulated or pulsed—offers significant advantages over the conventional constant-flow sustained-pressure approach. These findings highlight:

More Effective Fracture Propagation—Pulse-based fracturing introduces cyclic stress variations, which enhance fracture complexity by promoting multiple branching fractures rather than uniform planar fractures.

Improved Energy Transfer—Research shows that alternating pressure pulses improve stress redistribution, allowing more efficient energy delivery to the formation and minimizing frictional losses in the wellbore.

Superior Proppant Transport—Controlled pressure pulses create fluid acceleration-deceleration cycles, keeping proppant suspended for longer durations and ensuring more uniform placement within the fractures.

Reduced Water and Chemical Usage—By optimizing fracture efficiency, pulsed hydraulic fracturing can achieve similar or superior production performance with less water and fewer chemical additives, reducing environmental footprint.

While certain prior-art systems, such as those described in U.S. patent Ser. No. 12/084,954, introduce some level of pressure cycling, they remain limited in real-time adaptability and rely on predefined mechanical activation mechanisms. Specific limitations include:

Lack of Real-Time Control—Pulse generation in the prior disclosure is passively triggered and cannot be dynamically adjusted from the surface during operations.

Dependence on Tubular Movement—The prior disclosure relies on mechanical movement of tubulars to generate pressure pulses, limiting flexibility in downhole stimulation.

Limited Downhole Data Acquisition—The prior disclosure lacks real-time monitoring capabilities, relying instead on surface pressure readings, which provide only indirect and delayed insights into fracture behavior.

Accordingly, there is a need for an improved hydraulic fracturing system that enhances formation stimulation efficiency while addressing the limitations of surface-controlled techniques.

The present disclosure provides a novel solution by generating high frequency controlled cyclic pressure pulses at depth, directly within the wellbore. This approach enhances fracture propagation, optimizes proppant transport, and increases stimulated reservoir volume (SRV), leading to more effective and environmentally efficient reservoir stimulation.

SUMMARY OF THE DISCLOSURE

In one aspect, embodiments of the present disclosure relate to a hydraulic fracturing method utilizing controlled downhole pressure pulsing to enhance fracture propagation, proppant transport, and reservoir permeability. The method employs a downhole pulsing tool that dynamically generates localized pressure surges within the wellbore, ensuring effective stimulation of subsurface formations.

Unlike the system disclosed in U.S. patent Ser. No. 12/084,954, where the downhole reservoir stimulating tool is preset to actuate at a predetermined value, the present disclosure introduces a dynamically programmable design, allowing actuation thresholds to be modified from the surface during operations.

Unlike the system disclosed in U.S. patent Ser. No. 12/084,954, where the downhole reservoir stimulating tool is designed to generate a single pressure pulse upon each actuation by the downward movement of the tubulars, the present disclosure introduces a design that generates multiple self-sustaining pressure pulses, independent of tubular movement.

Unlike the system disclosed in U.S. patent Ser. No. 12/084,954, where the downhole reservoir stimulating tool lacks the capability to capture, store, or transmit data, the present disclosure introduces a downhole reservoir stimulation tool capable of capturing, storing, and analyzing real-time downhole pressure data. In some embodiments, the tool performs advanced data analyses, including but not limited to pressure decay trends and stimulated reservoir volume (SRV) calculations. Additionally, in other embodiments, the tool can be configured to interface with a mud pulse telemetry system or other downhole communication methods to transmit recorded data to the surface for real-time monitoring and optimization of fracturing operations.

Unlike the system disclosed in U.S. patent Ser. No. 12/084,954, where the nozzles of the injector tool are designed to eject fluid once the injector tool internal pressure exceeds the external pressure of the tool; the present disclosure incorporates specialized nozzles in the injector tool that allows fluid to be ejected only when a pre-determined differential pressure between the interior and exterior of the tool is achieved.

Unlike the system disclosed in U.S. patent Ser. No. 12/084,954, where the downhole reservoir stimulation system utilizes locking sleeves and expandable packers to anchor the stimulation tool to the wellbore casing; the present disclosure incorporates a specialized anchoring tool outfitted with specialized expandable blocks, as known to one familiar with the art of wellbore construction, designed to anchor the downhole reservoir stimulating tool to the wellbore casing. The anchoring tool is configured to be activated by, but not limited to, a ball drop mechanism or an RFID tag recognition mechanism.

Other aspects and advantages of the invention will be apparent from the following description and the appended claims.

DETAILED DESCRIPTION

Overview

The system disclosed herein functions similarly in certain foundational aspects to the system disclosed in U.S. application Ser. No. 12/084,954, incorporated herein by reference. However, significant and novel improvements are explicitly detailed and emphasized herein.

The following detailed description provides an in-depth explanation of embodiments of the present disclosure, referring to the accompanying drawings where applicable. While the invention is described in relation to specific implementations, variations and modifications may be made without departing from the scope of the disclosed embodiments.

System Overview

Figure 1:
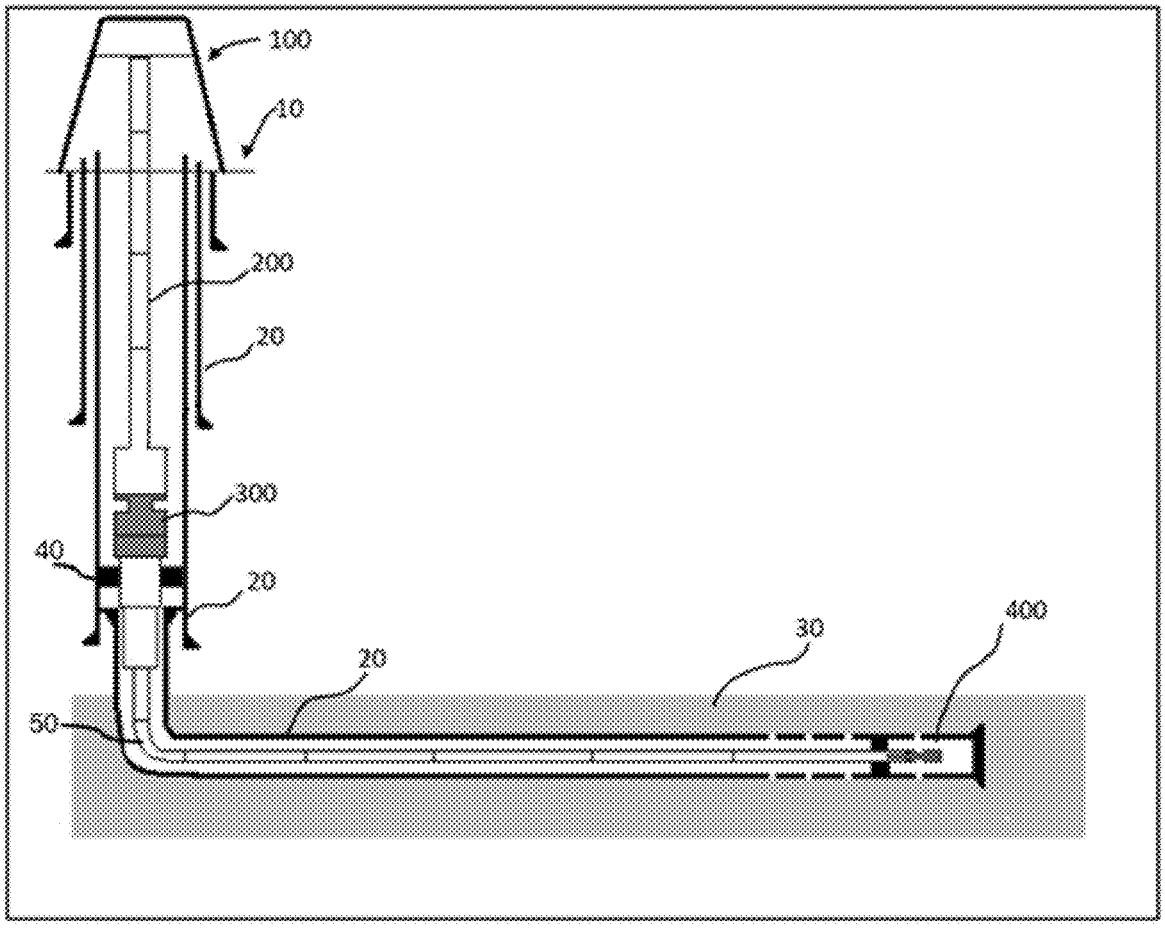
FIG. 1 is a schematic diagram of a downhole pulse hydraulic fracturing system incorporating a downhole reservoir stimulating tool and an injector tool.

In one aspect, referring to FIG. 1, the present disclosure relates to a downhole reservoir stimulation system 100 comprising a downhole reservoir stimulating tool 300, an injector tool 400, and a specialized anchoring tool 40, all coupled to a drill string 200. The system is configured to generate high-pressure fluid pulses to enhance fracture propagation and fracture density in the reservoir 30.

Figure 2A:
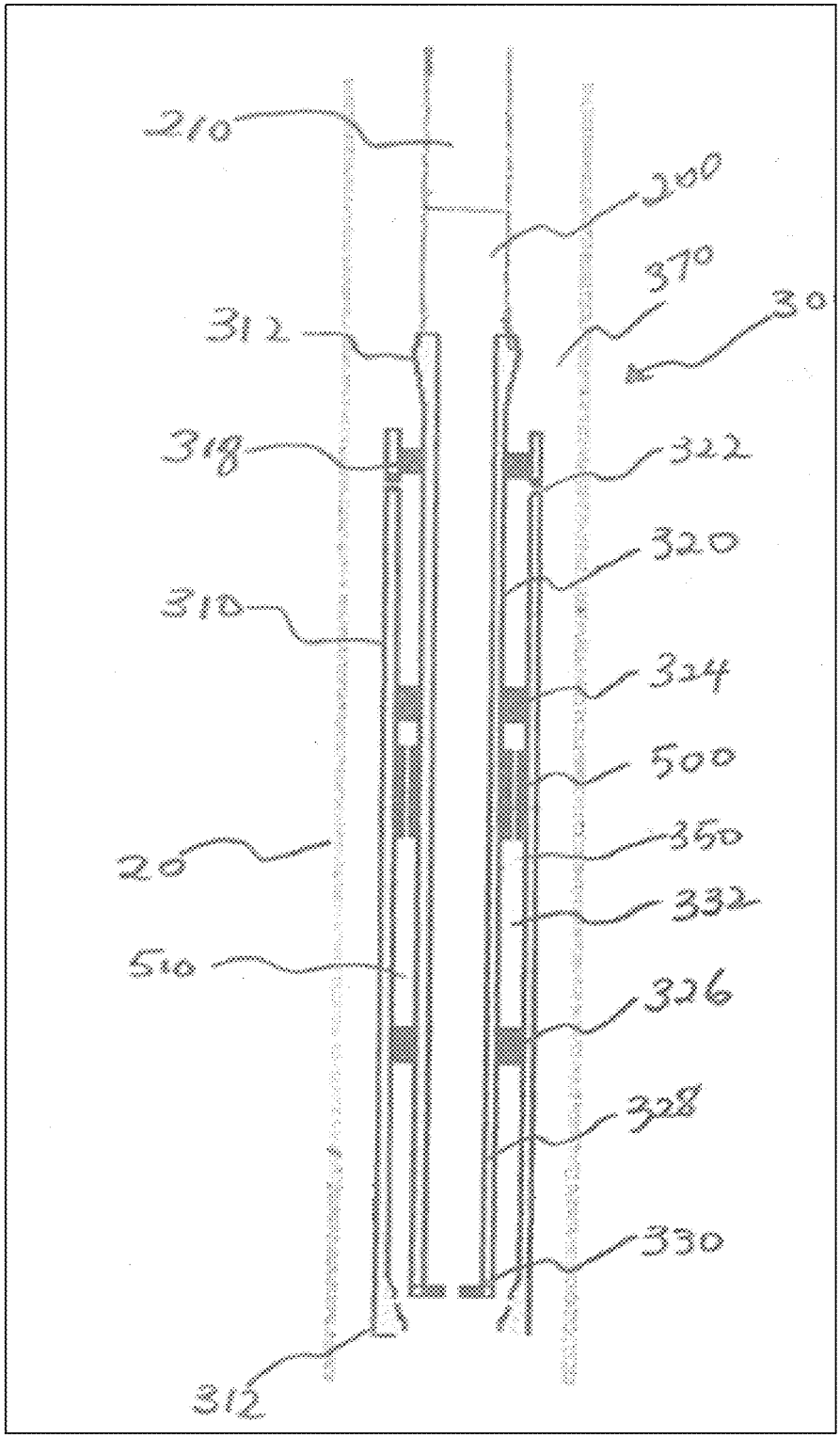
FIG. 2A illustrates a cross-sectional view of the downhole reservoir stimulating tool in the pulse energy storage phase; where compressional strain energy is stored prior to release.

Referring to FIGS. 1 and 2A. During operation, the downhole reservoir stimulating tool 300 temporarily restricts the movement of the inner mandrel 320 relative to the outer housing 310, causing an accumulation of compressional strain energy from the drill string tubulars 200 above the tool. This is achieved by stacking weight above the tool, a technique well known to those skilled in the art of drilling. The tool restricts the inner mandrel 320, forcing strain energy to build up. Energy is stored in the drill string tubulars 200 above the tool, until the system is triggered for release.

Upon activation, the inner mandrel 320 rapidly moves downward, converting stored compressional strain energy into a high-pressure fluid pulse. This fluid pulse propagates through the completion tubulars 50 toward the injector tool 400. The injector tool 400 is specifically configured with a one-way check valve at its entrance and a closed-end design at its distal end. This configuration ensures that once the downhole generated pressure pulse enters the injector tool, it is confined, triggering a series of internal reflections characterized by the Water Hammer Effect. These reflections amplify and intensify the pressure wave, producing multiple successive pressure spikes from each initial pulse, significantly increasing the fracturing potential and complexity within the subsurface formation 30.

Rapid changes in fluid flow rate, caused by the pulsing of the downhole tool, and the resulting internal reflections within the injector tool 400, driven by the Water Hammer Effect, create cyclic and amplified pressure pulses. Through wave superposition and repeated reflection, these cyclic pulses attain significantly enhanced amplitudes. Consequently, the intensified pressure pulses promote the creation of a more complex fracture network, effectively enhancing fracture propagation, proppant transport, and overall stimulated reservoir volume.

Unlike the system disclosed in U.S. patent Ser. No. 12/084,954, which utilizes a compressional tube to store strain energy before pulse activation, the present disclosure eliminates the need for a compressional tube. Instead, this present disclosure incorporates a more efficient energy storage and release mechanism that enables high frequency pulsing independent of tubular compression. This distinction improves operational reliability and simplifies system design.

Referring to FIG. 1, for clarity the illustration of a pump attached to the top of the drill string 200 is not included, but it is understood that fluid will be pumped from the surface as required in the hydraulic fracturing operations. Additionally, as one familiar in the skills in the art will appreciate, the downhole reservoir stimulating system may include other tools, such as locking sleeves, expandable packers, one-way check valves, pressure seals, etc.

Figure 2B:
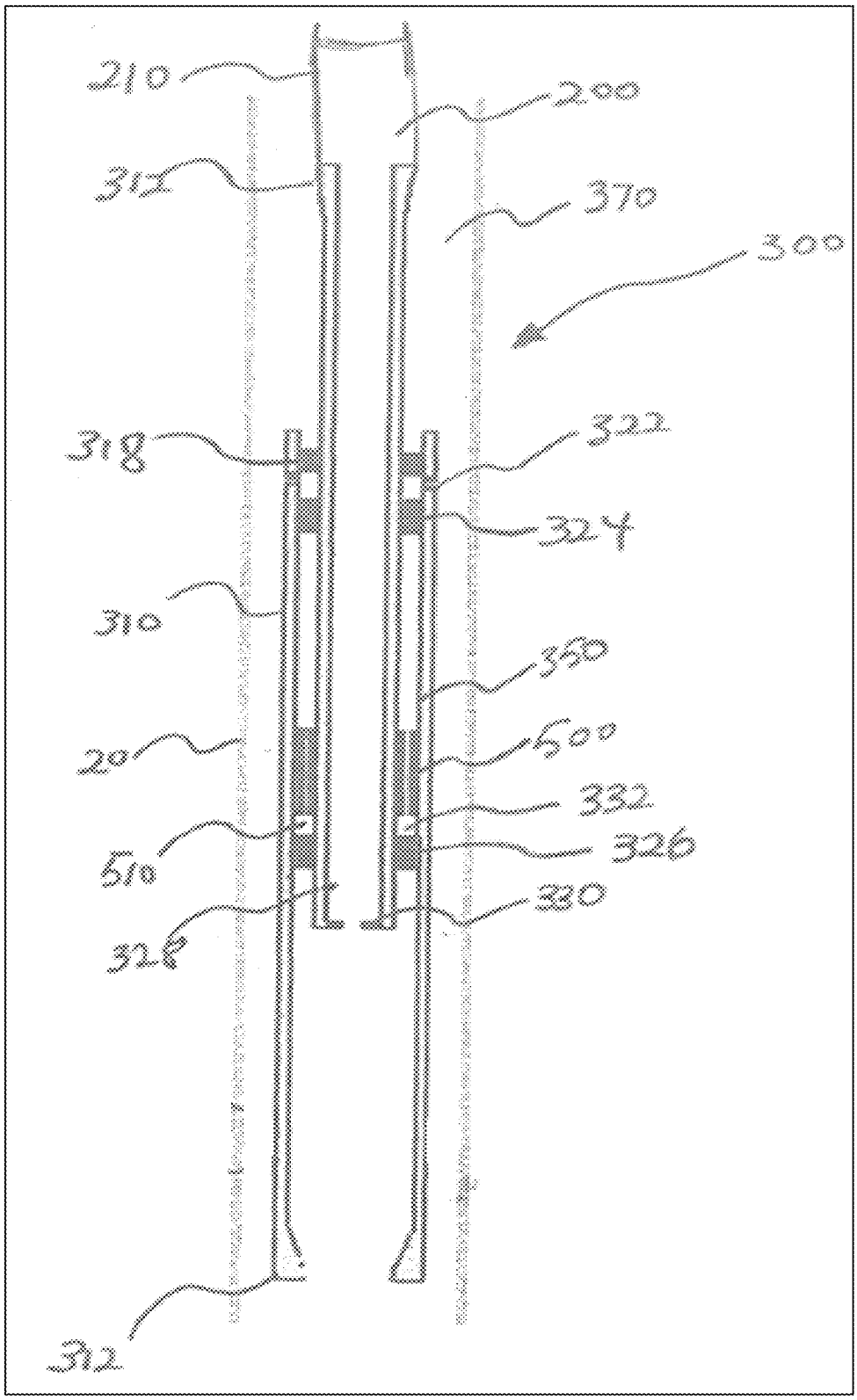
FIG. 2B illustrates a cross-sectional view of the downhole reservoir stimulating tool in the pulse energy release phase; where pressure pulses are propagated into the reservoir to stimulate fractures.

Referring now to FIG. 2A and FIG. 2B, a cross-sectional view of the downhole reservoir stimulating tool 300 is shown by embodiments of the present disclosure. The downhole reservoir stimulating tool 300 includes an outer housing 310 with connections 312, which allows the downhole reservoir stimulating tool 300 to be coupled to the drill string 200 (FIG. 1) and the completion tubulars 50 toward the injector tool 400.

Further, the downhole reservoir stimulating tool 300 includes an inner mandrel 320, a stationary top seal 318, refill ports 322, a fluid chamber 332 housing an electromagnetic flowmeter 500, a lower traveling seal 326, an upper traveling seal 324, a one-way flow control device 330 and an inner mandrel piston 328.

The electromagnetic flowmeter 500 is coupled to the inner surface 350 of the outer housing 310. One skilled in the art will understand the appropriate locations for the upper traveling seal 324, the lower traveling seal 326, and the electromagnetic flowmeter 500. As shown, the electromagnetic flowmeter 500 is disposed between the inner mandrel 320 and the outer housing 310. The upper traveling seal 324 and the lower traveling seal 326 are configured to allow the inner mandrel 320 to move independently from the outer housing 310. The electromagnetic flowmeter 500 is configured to remain stationary relative to the movement of the inner mandrel 320.

Both the inner mandrel 320 and the fluid chamber 332 containing the electromagnetic flowmeter 500 are disposed within the outer housing 310. One or more refill ports 322 in the sidewall of the outer mandrel 310 are configured to allow fluid to enter, which typically flows through a hollow central section of the inner mandrel 320 when the downhole reservoir stimulating tool 300 is being moved in the wellbore.

Figure 3:
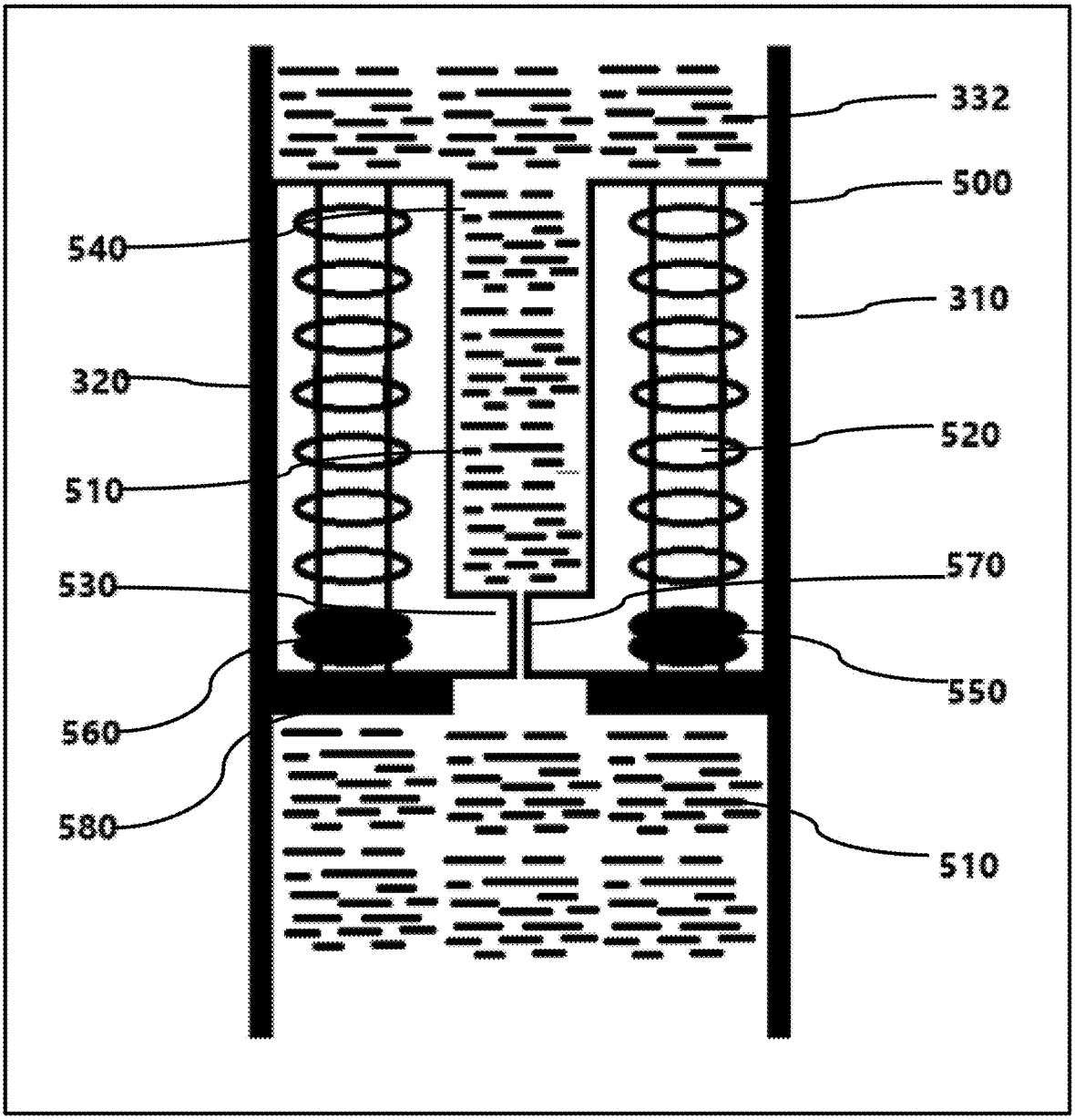
FIG. 3 illustrates a cross-sectional view of the electromagnetic flowmeter mechanism.

Referring now to FIG. 3, a cross-sectional view of the electromagnetic flowmeter 500 is shown in accordance with embodiments of the present disclosure. The electromagnetic flowmeter 500, in certain embodiments, will contain a magnetorheological fluid (MRF) 510, a chamber containing an electromagnetic coil 520, a power source 550, and a controlling switch 560 that may be activated by the compressional strain energy experienced on the inner mandrel 320. The fluid electromagnetic flowmeter 500 is configured with a fluid conduit 540 that runs through the tool tapering in diameter to a sized flowmeter orifice 570 and then tapering back to its original diameter.

As depicted, in FIG. 2A the outer housing 310 is configured to protect and contain components (i.e., electromagnetic flowmeter 500, inner mandrel 320, etc.) of the downhole reservoir stimulating tool 300. Furthermore, the housing 310 may also include at least one annular port 322 that provides a path for the fluid in the annulus 370 between the casing 20 and the drill string 200 to enter the downhole reservoir stimulating tool 300.

Figure 4:
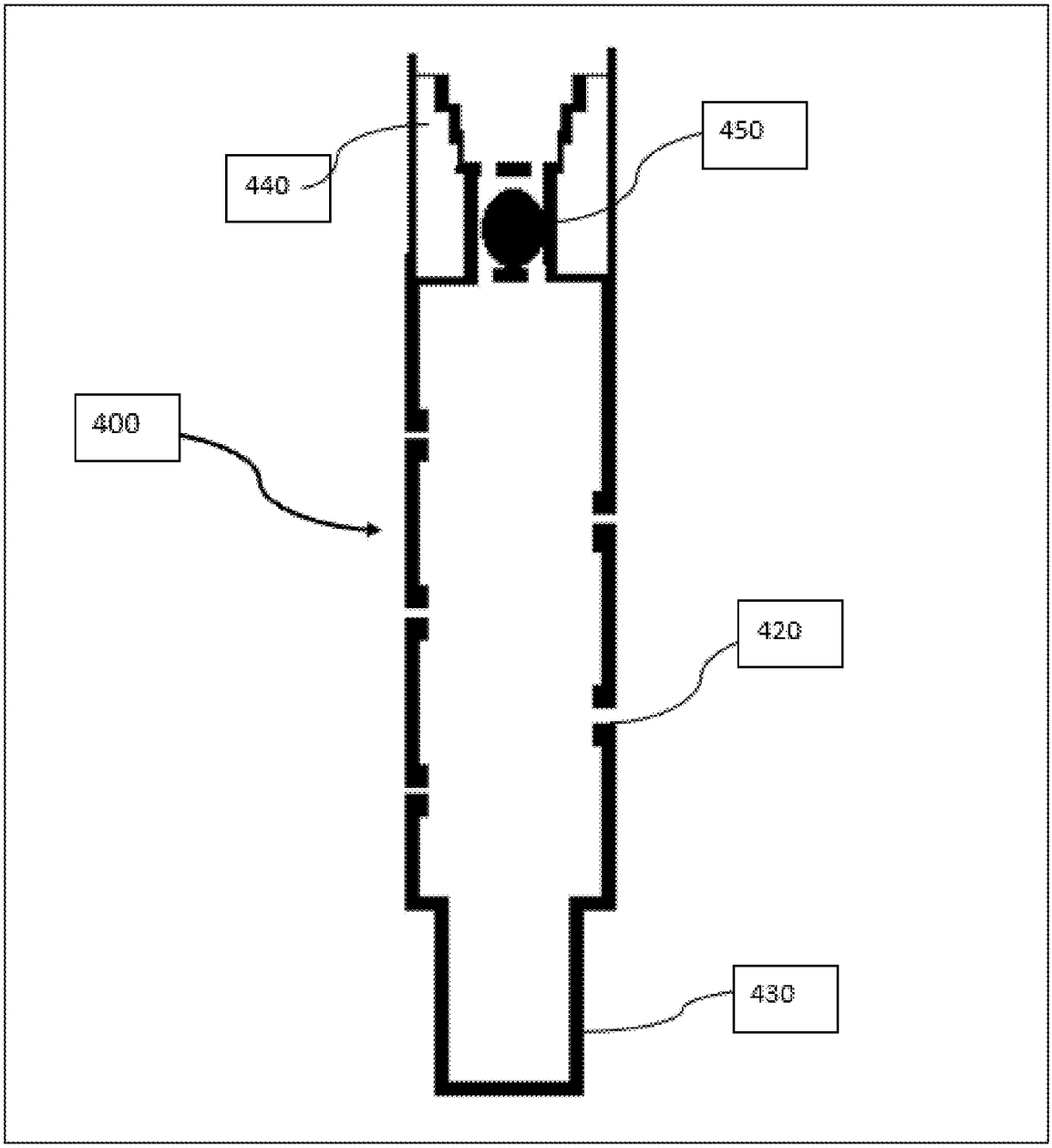
FIG. 4 illustrates a cross-sectional view of the injector tool showing the location of the specialized nozzles.

Referring to FIG. 4, the injector tool 400 is configured to manage and further propagate the high-pressure fluid that is being propagated from the downhole reservoir stimulating tool 300 to the surface of the subsurface formation 30 where it may cause the subsurface formation 30 to fracture. Consequently, this may result in fluid flowing outward from the injector tool 400, through the injector nozzle 420, and into the subsurface formation 30.

Additionally, in this present disclosure, the injector tool 400 may include specialized nozzles 420 configured into apertures on the outer wall of the injector tool modified to remain closed until a predefined differential pressure is reached. This allows the pressure in the injector tool to be amplified before fluid ejection. Additionally, there are specialized check valves 450, and a sealed bottom cap 430 which restricts fluid from going through the injector tool 400.

Method of Operations

Referring to FIGS. 1 and 2A, accordingly, during operation, the drill string 200 is lowered until the downhole reservoir stimulating tool reaches a predetermined position in the casing string 20 and the mechanism for the anchoring tool 40 is actuated causing the tool to be anchored into position.

Referring to FIG. 2A accordingly, during operations once the downhole reservoir stimulating tool 300 is locked into place at the predetermined position in the casing string 200, it is restricted from moving up or down. In this position, most of the magnetorheological fluid 510 is contained in the fluid chamber 332 below the electromagnetic flowmeter 500.

Referring now to FIG. 2A, accordingly during the operations, to activate the downhole reservoir stimulating tool, the drill string 200 is picked up slowly causing the inner mandrel of the downhole reservoir stimulating tool 320 to start moving upward relative to the outer mandrel 310.

Referring now to FIG. 1 and FIG. 2B, accordingly, during the operation the upward motion of the drill string 200 results in the downhole reservoir stimulating tool 300 becoming distended. The upward motion causes the lower traveling seal 326 and upper traveling seal 324 to move upward relative to the electromagnetic flowmeter 500.

Referring now to FIG. 2B and FIG. 3, the upper traveling seal 324 and the lower traveling seal 326 seals move up, the magnetorheological fluid 510 contained in the fluid chamber 332 is pushed through the fluid conduit 540 of the electromagnetic flowmeter 500 into the upper fluid chamber. The upward motion of the drill string 200 and subsequently the inner mandrel 320 causes the inner mandrel to go into tension causing the control switch 560 in the electromagnetic flowmeter 500 to be turned off subsequently deactivating the electromagnetic flowmeter 500.

The deactivated electromagnetic flowmeter 500 causes the viscosity of the magnetorheological fluid 510 in the electromagnetic flowmeter 500 to remain unchanged. The original viscosity of the magnetorheological fluid 510 is configured such that it allows the magnetorheological fluid 510 to readily flow across the flowmeter orifice 570 into the upper part of the fluid chamber 332 above the electromagnetic flowmeter 500.

Referring now to FIG. 1, FIG. 2A, and FIG. 3, the downward motion of the drill string 200 results in the downhole reservoir stimulating tool moving down lowering the inner mandrel 320 into the outer housing 310. The downward motion of the drill string 200 and subsequently the inner mandrel 320 causes the inner mandrel to go into compression causing the control switch 560 in the electromagnetic flowmeter 500 to be turned on subsequently activating the electromagnetic flowmeter 500.

The activated electromagnetic flowmeter 500 causes the viscosity of the magnetorheological fluid 510 in the electromagnetic flowmeter 500 to rapidly increase. The high viscosity of the magnetorheological fluid 510 is configured such that it restricts the magnetorheological fluid 510 from flowing across the flowmeter orifice 570 into the lower part of the fluid chamber 332 above the electromagnetic flowmeter 500.

The restriction of the magnetorheological fluid 510 temporarily stops the inner mandrel 320 from moving down into the outer housing 310 which results in the drilling tubulars 210 in the drill string 200 above the downhole reservoir stimulating tool 500 tool to go into compression.

Referring now to FIG. 3, the electromagnetic flowmeter 500 is configured to be deactivated when a pre-set threshold compressional strain is experienced by the inner mandrel 320 allowing the fluid viscosity of the magnetorheological fluid 510 inside the electromagnetic flowmeter 500 to immediately decrease and consequently start flowing rapidly across the flowmeter orifice 570 into the fluid chamber 332 below the electromagnetic flowmeter 500.

Referring now to FIG. 2A, the inner mandrel 320 is configured to travel rapidly down the outer housing 310 once the restriction of the flow of magnetorheological fluid 510 to the fluid chamber is removed. The inner mandrel 320 moves rapidly downward, due to the expansion of the compressed drill string tubulars, the expansion of the inner mandrel inside the compression tube 700, and the momentum of tubulars 210 located in the drill string 200 above the downhole reservoir stimulating tool 300.

The inner mandrel 320 is configured to travel down at a high velocity pushing the upper traveling seal 324, the lower traveling seal 326 and the inner mandrel piston 330.

Referring to FIG. 2A, the rapid downward movement of the lower traveling seal 326 and the inner mandrel piston 330 results in the fluid resident in the inside of the outer housing 310 below the inner mandrel piston 330 to rapidly increase in pressure consequently creating a high-pressure fluid wave that is propagated through the connection tubulars 50 below the tool towards the injector tool 400.

The operational process, as described in steps 0047 to 0061, used to energize and activate the downhole reservoir stimulating tool 300, can be repeated multiple times. One skilled in the art of drilling will understand the appropriate operations necessary required to re-energize and activate the tool by moving the drill string up and down using the rig apparatus.

Capturing, Storing and Transmitting Data

Unlike the system disclosed in U.S. patent Ser. No. 12/084,954, the present disclosure incorporates a downhole fluid pressure sensor. Referring still to FIGS. 2A and 2B, a downhole fluid pressure sensor (not shown) is embedded within the outer housing 310 to enable real-time detection of downhole fluid pressure. The pressure sensor is configured to analyze formation response and determine results such as, but not limited to, Stimulated Reservoir Volume (SRV), pressure decay trends, and pulse interactions. The system further comprises a data storage mechanism for recording pressure variations and pulse interaction data, enabling detailed post-fracturing analysis.

Capturing and analyzing downhole pressure data directly at the reservoir stimulation tool provides significantly higher-resolution insights compared to surface pressure measurements. Downhole data acquisition enables more precise analysis of pressure decay trends, pressure transients, and SRV, leading to improved characterization of fracture propagation, reservoir response, and overall stimulation effectiveness.

In certain embodiments, a data transmission system allows for real-time or delayed communication of stored results to the surface via mud pulse telemetry or alternative transmission methods, facilitating dynamic optimization of fracturing operations based on real-time downhole conditions.

Anchoring Mechanism

Unlike the system disclosed in U.S. patent Ser. No. 12/084,954, the present disclosure incorporates a specialized anchoring tool, referring to FIG. 1 40, outfitted with specialized expandable blocks, as known to one familiar with the art of wellbore construction, designed to anchor the downhole reservoir stimulating tool to the wellbore casing. The anchoring tool is configured to be activated by, but not limited to, a ball drop mechanism or an RFID tag recognition mechanism, not shown in FIG. 1.

The specialized anchoring tool improves the stability and reliability of the anchoring capability of the system as well as increase the efficiency of setting and resetting the tool as required. This design enhances operational performance, ensuring more effective stimulation and optimized reservoir performance.

Multiple Pulsing Mechanism

Unlike the system disclosed in U.S. patent Ser. No. 12/084,954, the present disclosure introduces a self-sustaining oscillatory pulsing mechanism, enabling continuous cyclic pressure pulses independent of tubular movement. Referring to FIGS. 2A and 2B, this is achieved through installing a Top Energy Storage Assembly (a spring-loaded or compressed gas chamber) positioned within the drilling tubulars 210, storing mechanical energy during compression. And a Bottom Energy Storage Assembly (a similar spring or compressed gas chamber) positioned below the inner mandrel piston 328 to sustain pulse oscillations. These energy storage components enable controlled energy release, producing continuous oscillatory high-pressure fluid pulses. This mechanism enables automated, high-frequency pulsing, significantly enhancing formation stimulation.

By enabling higher pulse frequencies, the system promotes more effective fracture propagation through cyclic loading-induced stress accumulation will improve proppant suspension and transport by ensuring proppant remains evenly distributed within the fractures.

Real Time Adaptive Pulse Intensity

Unlike the system disclosed in U.S. patent Ser. No. 12/084,954, where the downhole reservoir stimulating tool is preset to actuate at a predetermined value, the present disclosure introduces a dynamically programmable design, allowing actuation thresholds to be modified from the surface during operations. Referring to FIGS. 2A and 2B, this is achieved by the inclusion of a flow control device embedded, not shown, on the inner mandrel 320. The flow control device is configured to detect predefined triggers such as, but not limited to, a specific sequence of pressure pulses, a specific sequence of flow rate changes, or a specific RFID tag recognition. Upon recognition of the trigger, the flow control device adjusts the threshold parameters required for tool actuation, enabling adaptive pressure pulsing Incorporating the flow control device enables real-time adaptive pulsing in this present disclosure, allowing for dynamic control over pulse strength, frequency, and duration. This optimization enhances fracture efficiency, improves proppant transport, and maximizes permeability enhancement in hydraulic fracturing operations.

Injector Tool—Specialized Nozzles

Unlike the system disclosed in U.S. patent Ser. No. 12/084,954, where the nozzles of the injector tool were standard nozzles capable of ejecting fluid once the injector tool internal pressure exceeds the external pressure of the tool; the present disclosure incorporates specialized nozzles in the injector tool that allows fluid to be ejected only when a pre-determined differential pressure between the interior and exterior of the tool is achieved.

The enhanced nozzle system optimizes fluid ejection dynamics by regulating pressure buildup prior to activation. This controlled approach facilitates more effective fracture initiation, enhances proppant transport, and improves overall reservoir stimulation performance.

Embodiments disclosed herein may include combinations of any and/or all of the features described that are configured to induce fractures in the subsurface formation 30. Those skilled in the art will understand various combinations of all of the features described herein.

While the present disclosure has been described with respect to a limited number of embodiments, those skilled in the art, having the benefit of this disclosure, will appreciate that other embodiments may be devised which do not depart from the scope of the disclosure as described herein. Accordingly, the scope of the disclosure should be limited only by the attached claims.

What is claimed:

1. A downhole reservoir stimulation system comprising of: a) a downhole pulsing tool positioned within a wellbore, configured to generate multiple, self-sustained cyclic pressure pulses autonomously and independently of drill string tubular movements, b) a surface-controlled pulse adjustment mechanism configured to dynamically adjust pulse intensity, frequency, and duration in real-time based on downhole fluid pressure data and formation responses, c) a downhole pressure sensor integrated within the pulsing tool, configured to continuously monitor pulse interactions, the formation responses, pressure decay trends, and stimulated reservoir volume (SRV), d) an injector tool coupled below the downhole pulsing tool, comprising of specialized nozzles configured to remain closed until a predefined differential pressure is reached, ensuring controlled energy release and optimized proppant distribution into a subsurface formation; and e) an anchoring mechanism comprising of expandable blocks activated by at least one of an RFID tag recognition mechanism or ball drop mechanism, configured to securely anchor the downhole pulsing tool to a wellbore casing.

2. The downhole reservoir stimulation system of claim 1, further comprising: a mechanical energy storage mechanism including at least one of a spring-loaded assembly or a compressed gas chamber, configured to autonomously store and release mechanical energy, maintaining an oscillatory feedback loop for continuous cyclic pressure pulses.

3. A downhole hydraulic fracturing system for generating cyclic pressure pulses within a wellbore, the system comprising:

a) a downhole pulsing tool positioned within the wellbore and mechanically coupled to a drill string above the downhole pulsing tool, the pulsing tool comprising an inner mandrel piston and fluid chamber, the piston moves to create high-pressure fluid waves by rapidly increasing pressure in the system;

b) an injector tool positioned below the downhole pulsing tool, and in fluid communication therewith, the injector tool configured to receive the high-pressure fluid waves;

c) wherein the injector tool comprises:

a one-way check valve positioned at an inlet of the injector tool and configured to permit downward fluid flow while preventing reverse flow, and a closed distal end defining a confined fluid volume within the injector tool;

d) wherein the confined fluid volume and geometric configuration of the injector tool cause reflection of the high-pressure fluid waves, resulting in one or more amplified pressure pulses within the injector tool; and e) wherein the amplified pressure pulses are transmitted from the injector tool into a surrounding formation.

4. A method of hydraulically fracturing a subsurface formation using a downhole reservoir stimulation system, comprising of a) positioning a downhole pulsing tool within a wellbore, the downhole pulsing tool being capable of autonomous generation of cyclic pressure pulses independent of drill string tubular movements; b) activating the downhole pulsing tool to generate high-frequency pressure pulses; c) dynamically adjusting pulse pressure intensity, frequency, and amplitude from the surface in real-time, based upon formation response and downhole fluid pressure data captured by an integrated downhole pressure sensor; d) continuously monitoring pulse impact on the formation, including measurement of pressure decay trends and stimulated reservoir volume (SRV); e) controlling fluid injection through specialized injector tool nozzles, maintaining nozzle closure until a predefined differential pressure threshold is achieved, optimizing fluid pulse velocity, proppant transport efficiency, and fracture complexity; and f) transmitting collected downhole pressure data and analysis results to the surface for real-time or post-operation analysis.

5. The method of claim 4, wherein cyclic pressure pulses autonomously sustain themselves via a mechanical oscillatory feedback mechanism, employing stored mechanical energy from at least one of a spring-loaded assembly or a compressed gas chamber.

6. The method of claim 4, further comprising: remotely activating a specialized anchoring mechanism via at least one of an RFID tag recognition mechanism or a ball drop mechanism to securely position and anchor the downhole pulsing tool within a wellbore casing.

* * * * *